US007442065B2

(12) United States Patent
Kuwayama

(10) Patent No.: US 7,442,065 B2
(45) Date of Patent: Oct. 28, 2008

(54) CONNECTOR

(75) Inventor: Yasumichi Kuwayama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/698,979

(22) Filed: Jan. 29, 2007

(65) Prior Publication Data

US 2007/0178739 A1 Aug. 2, 2007

(30) Foreign Application Priority Data

Jan. 27, 2006 (JP) ..... 2006-019396

(51) Int. Cl.
*H01R 13/627* (2006.01)

(52) U.S. Cl. ..... 439/352

(58) Field of Classification Search ..... 439/350–358
See application file for complete search history.

(56) References Cited

U.S. PATENT DOCUMENTS

| | | | | |
|---|---|---|---|---|
| 4,946,395 | A * | 8/1990 | Cope et al. | 439/352 |
| 5,879,180 | A * | 3/1999 | Iwahori et al. | 439/352 |
| 6,443,760 | B2 * | 9/2002 | Hasegawa | 439/489 |
| 6,644,996 | B2 * | 11/2003 | Yamashita | 439/352 |
| 6,716,052 | B2 * | 4/2004 | Kane | 439/352 |
| 6,769,929 | B2 * | 8/2004 | Saka et al. | 439/352 |
| 6,935,887 | B2 * | 8/2005 | Endo | 439/489 |
| 2003/0003792 | A1 * | 1/2003 | Endo | 439/352 |
| 2003/0049959 | A1 * | 3/2003 | Yamashita | 439/352 |
| 2003/0087545 | A1 * | 5/2003 | Nimura | 439/352 |
| 2004/0067676 | A1 * | 4/2004 | Nimura | 439/352 |
| 2006/0079110 | A1 * | 4/2006 | Ichida et al. | 439/352 |
| 2007/0059969 | A1 * | 3/2007 | Shamoto | 439/352 |

FOREIGN PATENT DOCUMENTS

JP 9-219255 A 8/1997

* cited by examiner

*Primary Examiner*—Gary F. Paumen
(74) *Attorney, Agent, or Firm*—Sughrue Mion, PLLC

(57) ABSTRACT

A connector 10 includes a male connector housing 14 having a retaining projection 19, a female connector housing 17 having an elastic lock arm 28 which is brought into retaining engagement with the retaining projection 19 when the male connector housing 14 is inserted and fitted into the female connector housing, and a fitting-ensuring member 13 which is brought into engagement with the elastic lock arm 28, retainingly engaged with the retaining projection 19, to hold the elastic lock arm 28 against elastic deformation. An abutment portion 38 is formed at one of the female connector housing 17 and the fitting-ensuring member 13, and during the movement of the fitting-ensuring member 13, the abutment portion 38 causes the fitting-ensuring member 13 to drop into the elastic lock arm 28.

2 Claims, 7 Drawing Sheets

CONNECTOR

BACKGROUND OF THE INVENTION

1. Field of the Invention

This invention relates to a connector in which an elastic lock arm formed on a connector housing is held against elastic deformation by a fitting-ensuring member, thereby locking the fitted male and female connector housings together in a double manner.

2. Description of the Related Art

There is known one conventional connector in which when a male connector housing and a female connector housings are provisionally retained relative to each other, a retaining projection of a fitting detection member is engaged with a lock projection of the male connector housing (see, for example, JP-A-9-219255 Publication (FIGS. 1 to 5)).

In the connector 100 disclosed in Patent Literature 1, the fitting detection member 101 has an elastic detection arm 102 for an abutment projection 111 of the male connector housing 110. When the fitting detection member 101 is pushed in a connector fitting direction, the elastic detection arm 102, while elastically deformed, is advanced, and the retaining projection 103 formed at a distal end of the elastic detection arm 102 slides on the lower side of the lock projection 112 of the male connector housing 110, and then is brought into engagement with a front end of the lock projection 112.

However, in the conventional connector 100 disclosed in the above Patent Literature 1, the abutment projection 111 is disposed rearwardly of the lock projection 112, and therefore during the advancing movement of the fitting detection member 101, its distal end portion must be slid while being much elastically deformed. As a result, a large inserting force is required, and therefore it is difficult to positively effect a double lock, and the efficiency of the operation is not good.

And besides, since the elastic detection arm 102 is advanced while being elastically deformed, the elastic detection arm 102 need to have a relatively large length, and this makes it difficult to achieve a compact design.

SUMMARY OF THE INVENTION

This invention has been made in view of the above circumstances, and an object of the invention is to provide a connector in which a positive double lock can be secured, and besides the efficiency of an operation is enhanced, and furthermore a compact design can be achieved.

1) According to the present invention, there is provided a connector comprising a male connector housing having a retaining projection, a female connector housing having an elastic lock arm which is brought into retaining engagement with the retaining projection of the male connector housing when the male connector housing is inserted and fitted into the female connector housing, and a fitting-ensuring member which is brought into engagement with the elastic lock arm, retainingly engaged with the retaining projection, to hold the elastic lock arm against elastic deformation; characterized in that the female connector housing includes a hood portion disposed outwardly of the elastic lock arm, and a guide for supporting the fitting-ensuring member in a manner to enable a movement of the fitting-ensuring member; and an abutment portion is formed at one of the hood portion and the fitting-ensuring member, and during the movement of the fitting-ensuring member through the guide, the abutment portion abuts against a distal end portion of the fitting-ensuring member to cause the fitting-ensuring member to drop into the elastic lock arm.

In the invention of the above Paragraph 1) the fitting-ensuring member is dropped through the abutment portion to hold the elastic lock arm against elastic deformation. Therefore, the fitting-ensuring member differs from the conventional fitting detection member in that the conventional fitting detection member is slid while its distal end portion is much elastically deformed. Therefore, the double lock can be effected with the simple operation without requiring a large inserting force. And besides, the fitting-ensuring member has no elastic detection arm (as in the conventional construction) which is advanced while being elastically deformed, and therefore the double lock can be effected in a space-saving manner. Therefore, the positive double lock can be secured, and besides the efficiency of the operation can be enhanced, and furthermore the compact design can be achieved.

2) The connector of the above Paragraph 1) is further characterized in that the elastic lock arm has a lock portion for retaining engagement with the retaining projection of the male connector housing, and the fitting-ensuring member has an engagement portion for engagement with the lock portion of the elastic lock arm, and when the engagement portion of the fitting-ensuring member is to be brought into engagement with the lock portion of the elastic lock arm through the abutment portion, the fitting-ensuring member slides past the-retaining projection and the lock portion.

In the invention of the above Paragraph 2), when the engagement portion of the fitting-ensuring member is to be brought into engagement with the lock portion of the elastic lock arm through the abutment portion, the fitting-ensuring member slides past the retaining projection of the male connector housing and the lock portion of the elastic lock arm. Therefore, the fitting-ensuring member can lock the retaining projection and the lock portion together in a double manner with the simple structure, and a mold of a complicated shape is not required, and therefore the productivity can be enhanced.

The connector of the invention can solve the problems that it is difficult to secure a positive double lock, that the efficiency of the operation is not good and that it is difficult to achieve a compact design, and therefore there are obtained advantages that the positive double lock can be secured, that the efficiency of the operation can be enhanced and that the compact design can be achieved.

DESCRIPTION OF THE PREFERRED EMBODIMENTS

A preferred embodiment of the present invention will now be described in detail with reference to the drawings.

Figure 1:
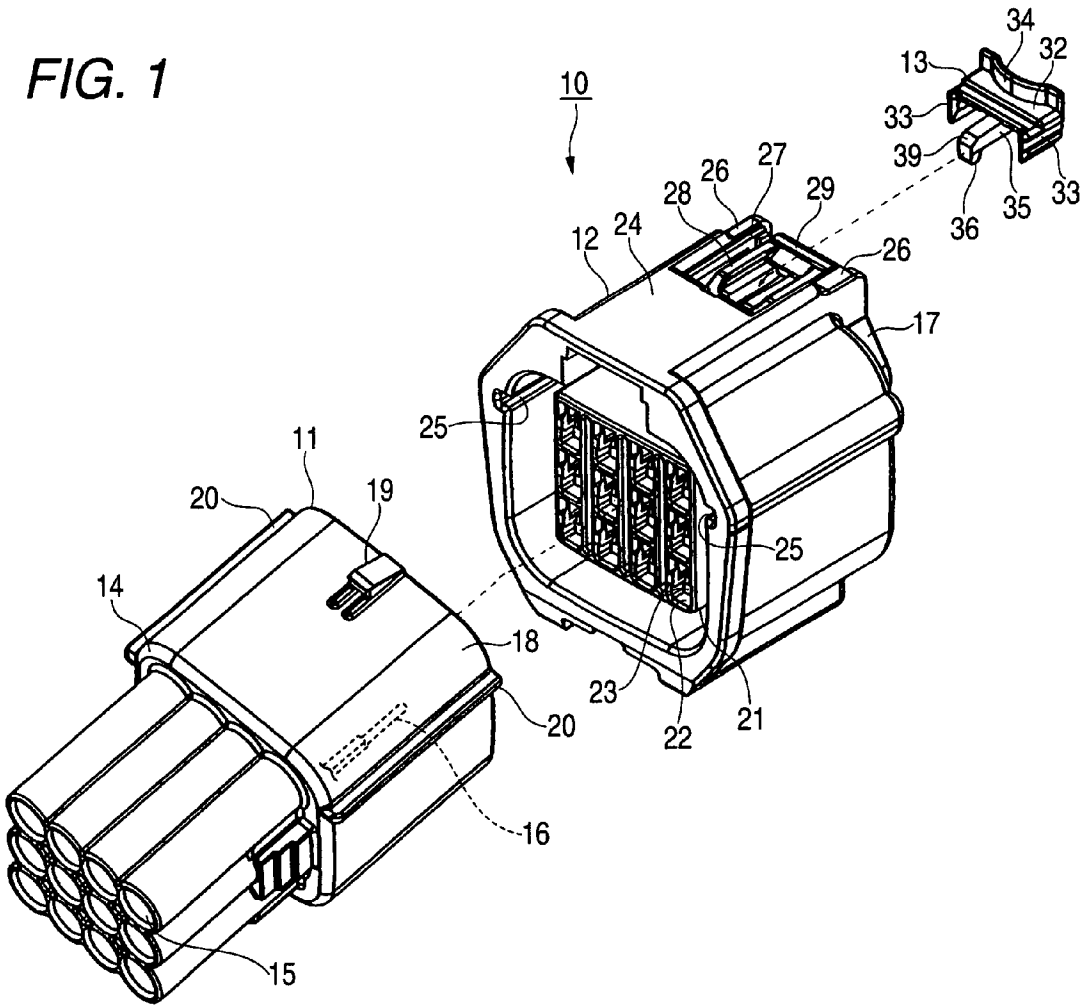
FIG. 1 is an exploded, perspective view of one preferred embodiment of a connector of the present invention.
Figure 2:
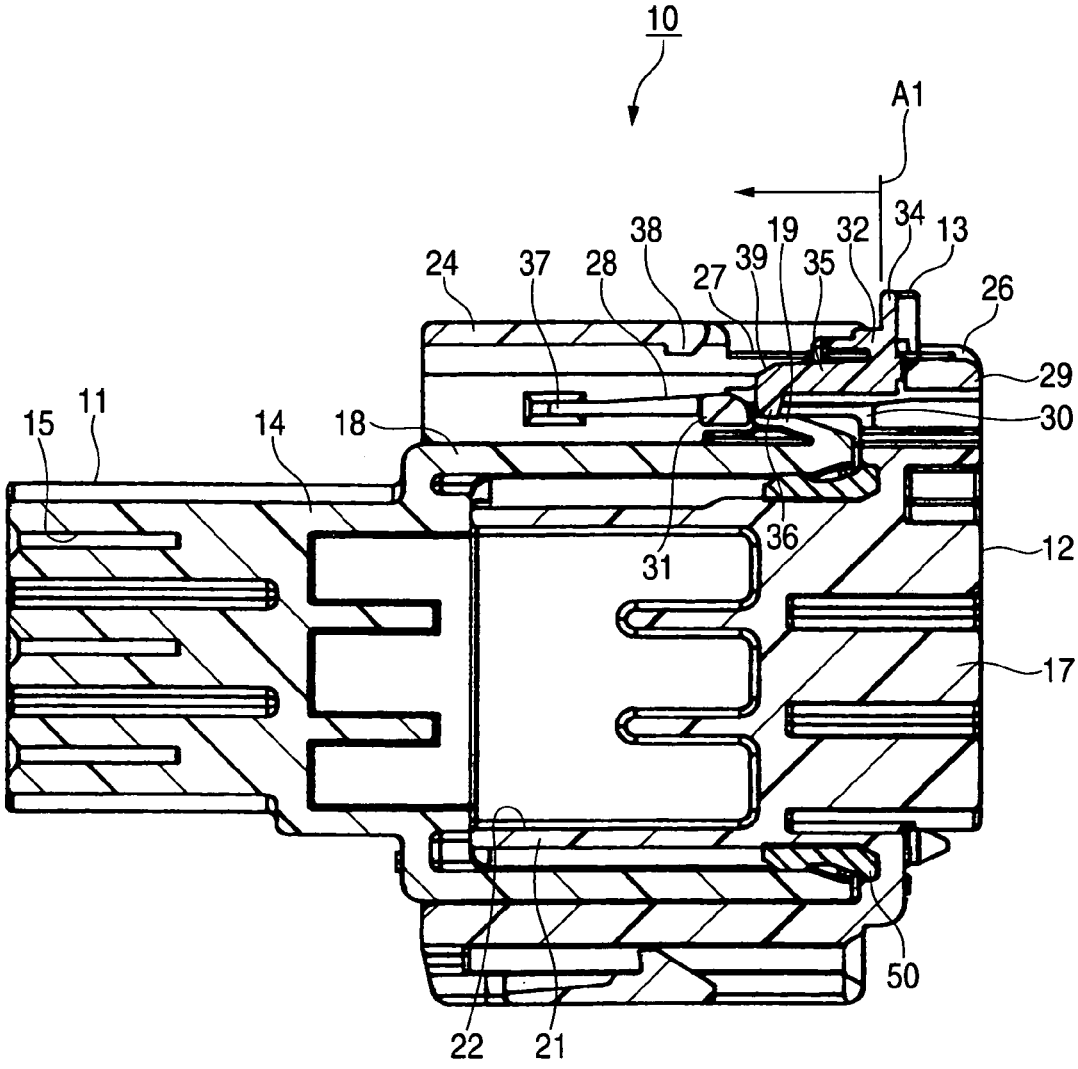
FIG. 2 is a vertical cross-sectional view of the connector of FIG. 1, showing a fitting-ensuring member in a provisionally-retained condition.
Figure 3:
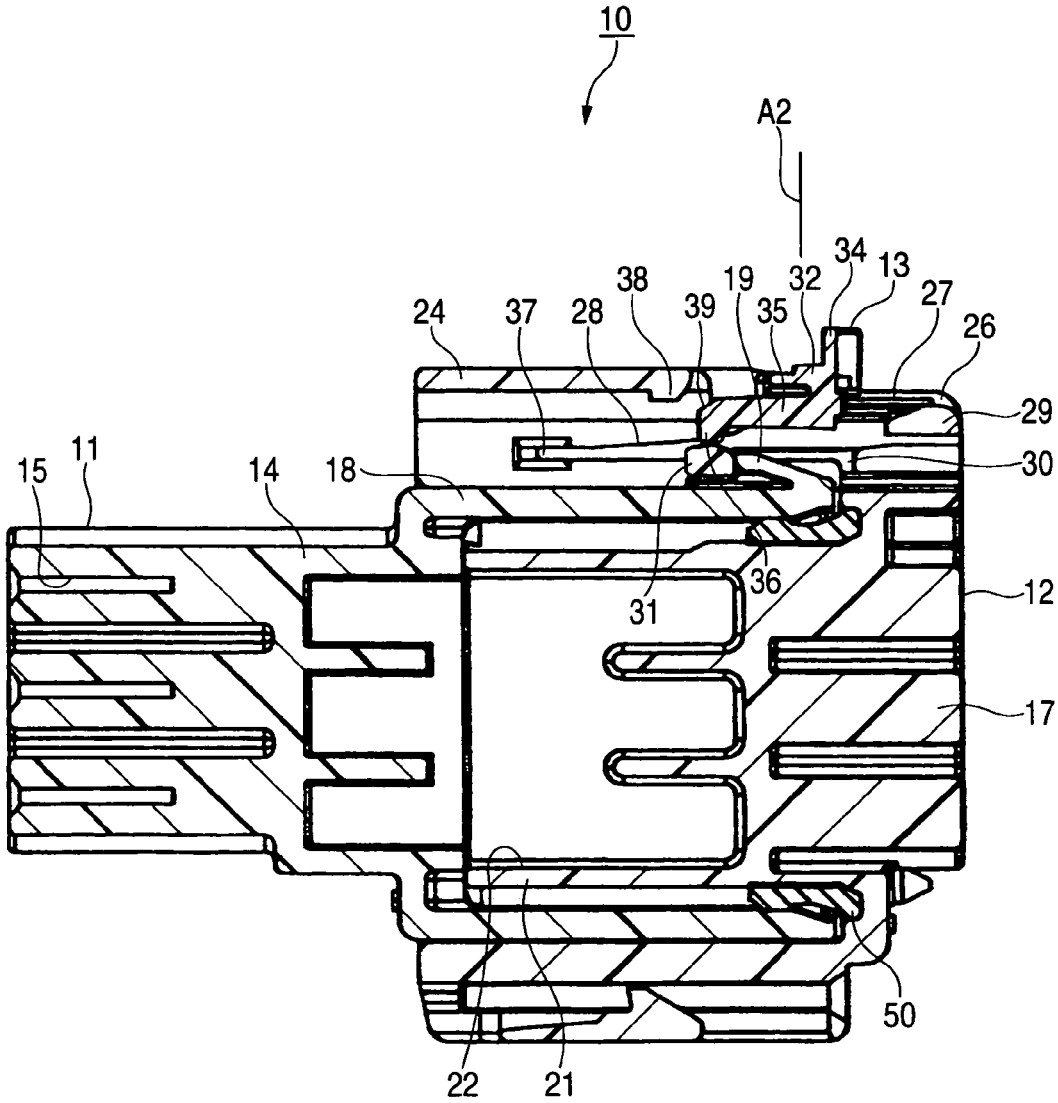
FIG. 3 is a vertical cross-sectional view of the connector of FIG. 1, showing a first half of a process of shifting of the fitting-ensuring member from the provisionally-retained condition to a completely-retained condition.
Figure 4:
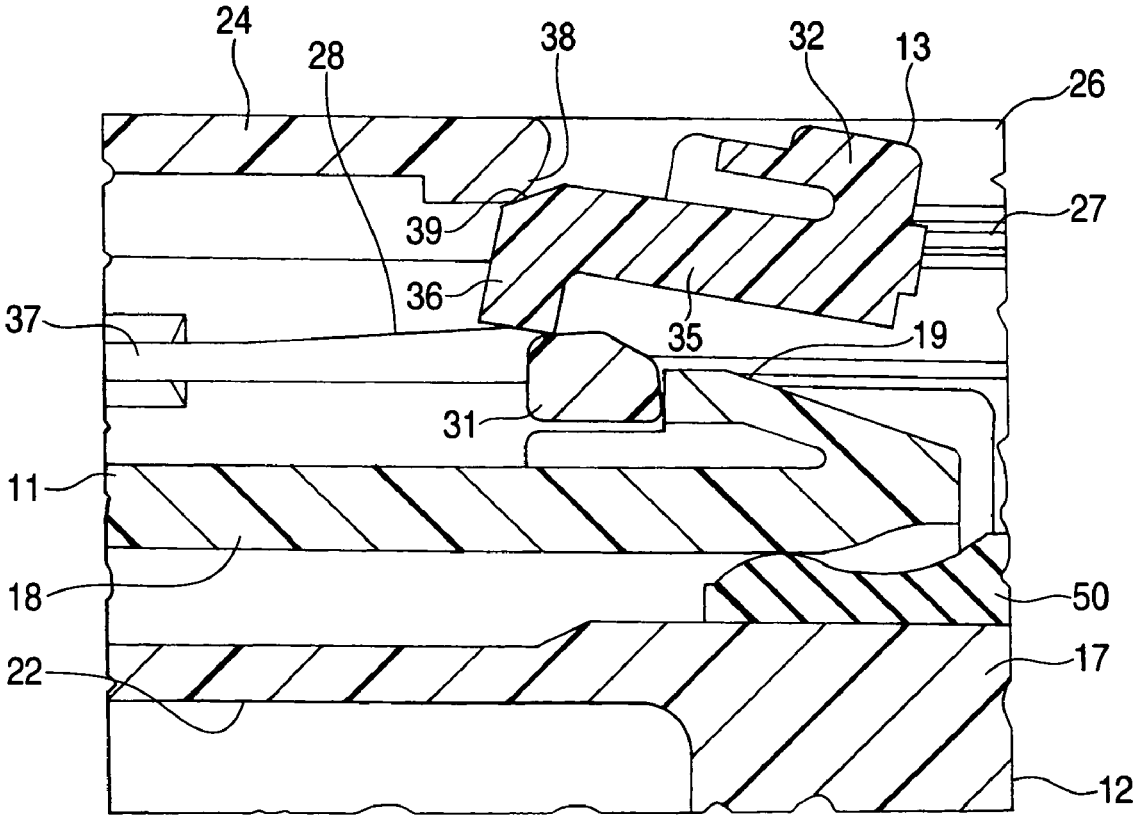
FIG. 4 is an enlarged view of an important portion, showing a second half of the shifting process of FIG. 3.
Figure 5:
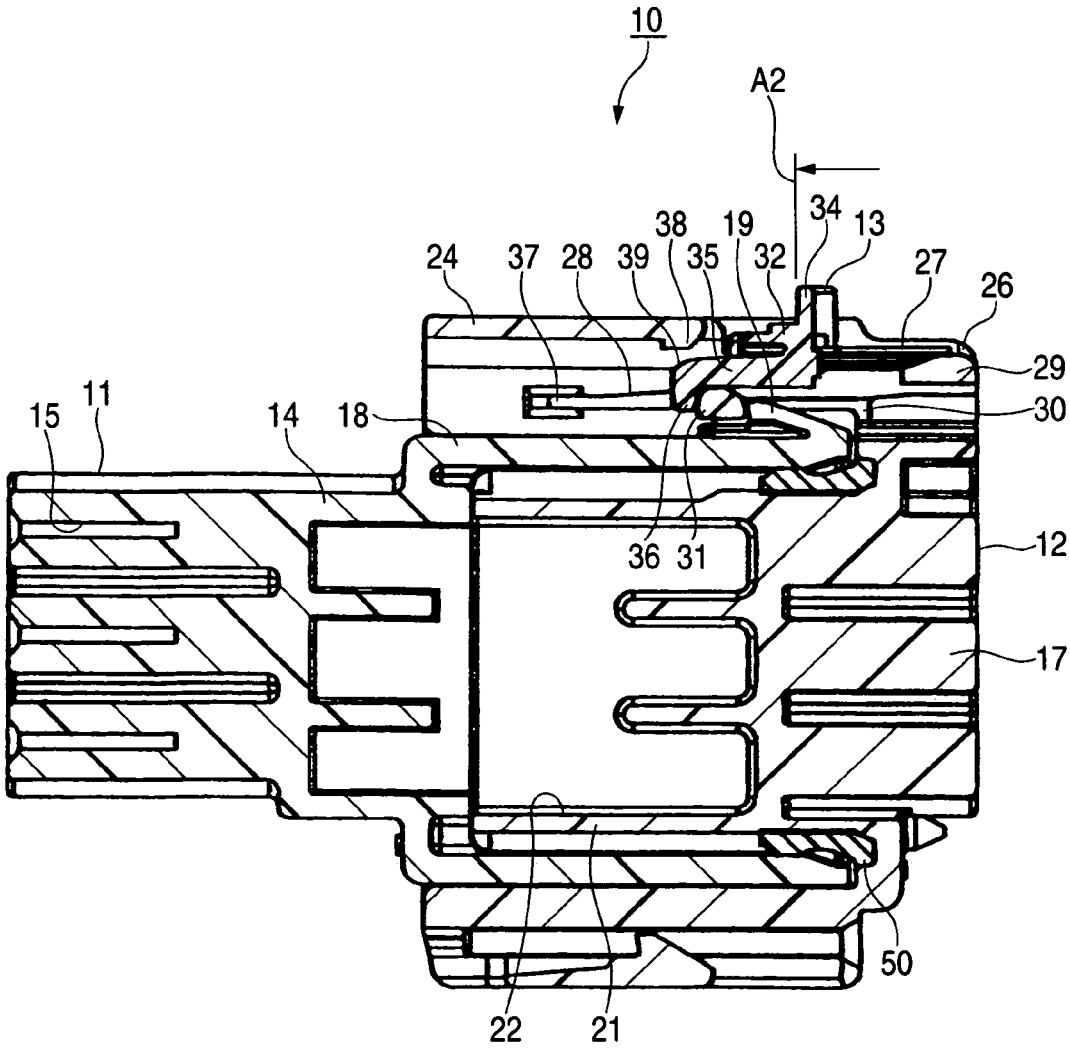
FIG. 5 is a vertical cross-sectional view of the connector of FIG. 1, showing the fitting-ensuring member in the completely-retained condition.
Figure 6:
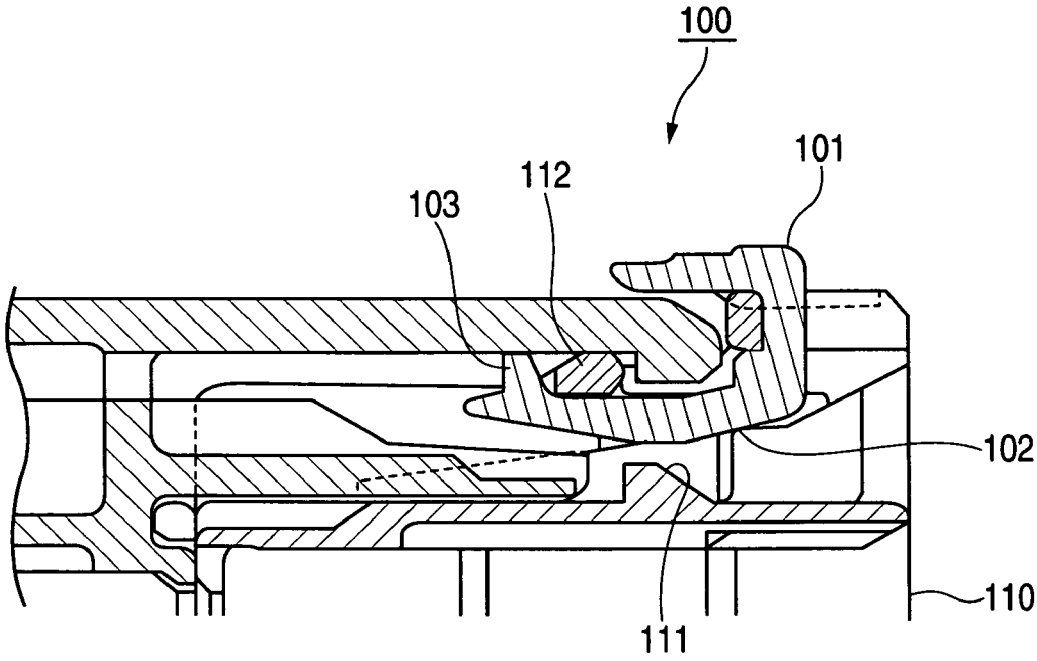
FIG. 6 is a cross-sectional view of a conventional connector.

FIG. 1 is an exploded, perspective view of one preferred embodiment of a connector of the invention, FIG. 2 is a vertical cross-sectional view of the connector of FIG. 1, showing a fitting-ensuring member in a provisionally-retained condition, FIG. 3 is a vertical cross-sectional view of the connector of FIG. 1, showing a first half of a process of shifting of the fitting-ensuring member from the provisionally-retained condition to a completely-retained condition, FIG. 4 is an enlarged view of an important portion, showing a second half of the shifting process of FIG. 3, and FIG. 5 is a vertical cross-sectional view of the connector of FIG. 1, showing the fitting-ensuring member in the completely-retained condition.

As shown in FIG. 1, one preferred embodiment of the connector 10 of the invention comprises a male connector 11, a female connector 12, and the fitting-ensuring member 13.

The male connector 11 includes a male connector housing 14 molded of an insulative synthetic resin, and twelve terminal receiving chambers 15 are formed within the male connector housing 14, and are arranged in four rows and three columns. Male terminals 16 are received in the terminal receiving chambers 15, respectively. The male terminals 16 are electrically connected to circuits (not shown). The male connector housing 14 includes a male connector hood 18 of a tubular shape for insertion into a female connector housing 17 of the female connector 12. A retaining projection 19 is formed on an upper surface of a front end portion of the male connector hood 18. The male connector hood 18 has a pair of guide projections 20 and 20 formed respectively on opposite side surfaces thereof.

The female connector housing 17 of the female connector 12 is molded of an insulative synthetic resin, and has a terminal cavity 21 formed therein. Twelve terminal receiving chambers 22 are formed within the terminal cavity 21, and are arranged in four rows and three columns. Female terminals 23 are received in the terminal receiving chambers 22, respectively. An O-ring 50 (see FIG. 2) for watertight sealing purposes is fitted on the terminal cavity 21. The female terminals 23 are electrically connected to circuits (not shown). The female connector housing 17 has a female connector hood 24 of a tubular shape for receiving the male connector hood 18 therein. Guide grooves 25 and 25 are formed in an inner surface of this female connector hood 24, and the guide projections 20 and 20 of the male connector hood 18 are inserted respectively into these guide grooves 25 and 25 in the connector fitting direction.

In the female connector housing 17, that portion of an upper wall of the female connector hood 24 extending from a central portion thereof to a rear end thereof is removed to provide an opening, and a pair of projecting plates 26 and 26 are provided respectively at opposite sides of this opening, and fitting-ensuring member guide projections 27 ad 27 are formed respectively on inner surfaces of the projecting plates 26 and 26. An elastic lock arm 28 is disposed between the projecting plates 26 and 26. The elastic lock arm 28 has a cantilever-like tongue-shape, and is connected to a central portion of the reverse surface of the female connector hood 24, and further has an operating portion 29 formed at a rear end thereof. When the operating portion 29 is pressed down, a lock portion 31 (see FIG. 2) formed at a central portion of the elastic lock arm 28 is displaced upward through fulcrum portions 30 (see FIG. 2) in a see-saw like manner.

Like the male connector housing 14 and the female connector housing 17, the fitting-ensuring member 13 is molded of an insulative synthetic resin, and includes a plate-like body 32 having a pair of guide grooves 33 and 33 formed respectively in opposites side portions thereof. A pressing projection 34 is formed on the body 32. The fitting-ensuring member 13 further includes an arm portion 35 formed at a central portion of the body 32, and an engagement portion 36 of a generally L-shape formed a distal end of the arm portion 35. The guide grooves 33 and 33 of the fitting-ensuring member 13 are fitted respectively on the fitting-ensuring member guide projections 27 and 27 of the female connector hood 24, and by doing so, the fitting-ensuring member 13 is mounted on the female connector housing 17 in such a manner that this fitting-ensuring member 13 is movably supported by the fitting ensuring-member guide projections 27 and 27.

In the connector 10, the male connector hood 18 of the male connector housing 14 is inserted into the female connector hood 24 of the female connector housing 17, with the guide projections 20 and 20 of the male connector hood 18 fitted respectively in the guide grooves 25 and 25 of the female connector hood 24. Then, when the retaining projection 19 of the male connector housing 14 slides past the lock portion 31 of the elastic lock arm 28, and is retainingly engaged with this lock portion 31, a provisionally-fitted condition of the connector 10 is achieved. Thereafter, the fitting-ensuring member 13 is moved sequentially into the provisionally-retained condition and the completely-retained condition.

Next, the movement of the fitting-ensuring member 13 into the provisionally-retained condition and the completely-retained condition will be described.

In the female connector housing 17, the pair of fulcrum portions 30 and 30 are formed in a projecting manner between the two projecting plates 26 and 26, and the elastic lock arm 28 has the lock portion 31 disposed between its connecting portions 37 and 37 (connected respectively to opposed side surfaces of the female connector housing 24) and the operating portion 29 as shown in FIG. 2. When the operating portion 29 is pressed down, the lock portion 31 (see FIG. 2) formed at the central portion of the elastic lock arm 28 is displaced upward through the fulcrum portions 30 and 30 in a see-saw like manner, and therefore the lock portion 31 is brought out of retaining engagement with the retaining projection 19 of the male connector housing 14, thereby canceling the provisionally-fitted condition.

Figure 7:
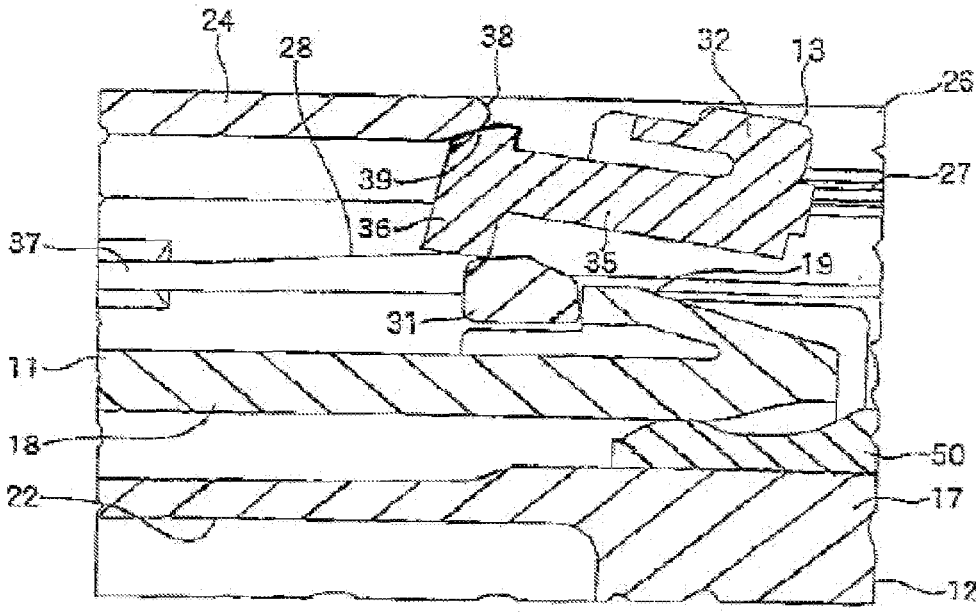
FIG. 7 is an enlarged view of an important portion, showing an alternative arrangement to FIG. 4 for the second half of the shifting process of FIG. 3.

In the female connector housing 17, an abutment portion 38 having a slanting surface is formed at the rear end (defining an edge of the above-mentioned opening) of the upper wall of the female connector hood 24. During the movement of the fitting-ensuring member 13, a receiving surface 39 formed at the distal end of the arm portion 35 is brought into abutting engagement with the abutment portion 38, so that the abutment portion 38 changes the direction of movement of the arm portion 35, that is, directs the arm portion 35 downward, and causes the engagement portion 36 to drop to the front side of the lock portion 31. Incidentally, the abutment portion 38 may be formed not on the female connector hood 24 but at the distal end portion of the arm portion 35 of the fitting-ensuring member 13, in which case the receiving surface 39 is formed at the rear end of the upper wall of the female connector hood 24, as illustrated in FIG. 7.

In the fitted condition of the connector 10 in which the retaining projection 19 of the male connector housing 14, slid past the lock portion 31 of the elastic lock arm 28, is retainingly engaged with this lock portion 31, the fitting-ensuring member 13 is disposed in a provisionally-retaining position A1. At this time, the engagement portion 36 of the fitting-ensuring member 13 is held in contact with the upper surface of the retaining projection 19 of the male connector housing 14, but does not press this retaining projection 19. Then, the pressing projection 34 of the fitting-ensuring member 13 is pressed and pushed in a left direction (in FIG. 2) by the operator.

When the fitting-ensuring member 13 is thus pressed and pushed in the left direction, this fitting-ensuring member 13, while supported by the fitting-ensuring member guide projections 27 and 27, is slid toward a completely-retaining position A2 as shown in FIG. 3. During the sliding movement of the fitting-ensuring member 13 toward the completely-fitting position A2, the engagement portion 36 advances while sliding over the lock portion 31 of the elastic lock arm 28. At this time, even if the lock portion 31 of the elastic lock arm 28 is disposed in an upwardly-displaced position, the advancing engagement portion 36 presses the lock portion 31 downward, and therefore the lock portion 31 will not be brought out of retaining engagement with the retaining projection 19.

When the fitting-ensuring member 13 further advances toward the completely-retaining position A2 as shown in FIG. 4, the receiving surface 39 formed at the distal end of the arm portion 35 is brought into abutting engagement with the abutment portion 38 of the female connector hood 24. At this time, the direction of movement of the arm portion 35 is forcibly changed, that is, the arm portion 35 is forcibly directed downward by a component force developing as a result of this abutting engagement, since the abutment portion 38 has the slanting surface. As a result, the engagement portion 36 slides past the lock portion 31 of the elastic lock arm 28.

After the engagement portion 36 thus slides past the lock portion 31 as a result of abutment of the receiving portion 39 against the abutment portion 38, the fitting-ensuring member 13 reaches the completely-retaining position A2, so that the engagement portion 36 is engaged with the front side (or surface) of the lock portion 31 as shown in FIG. 5. As a result, the connector 10 is kept in the completely-fitted condition in which the retaining projection 19 of the male connector housing 14 is retainingly engaged with the lock portion 31 of the elastic lock arm 28, and also the fitting-ensuring member 13 prevents the lock portion 31 from being displaced upward. In this condition, when the operating portion 29 of the elastic lock arm 28 is pressed down, the lock portion 31 pushes the arm portion 35 upward. However, the upper surface of the arm portion 35 is brought into abutting engagement with the abutment portion 38, and therefore the engagement of the retaining projection 19 with the lock portion 31 is prevented from being canceled.

Thus, in the connector 10, merely by sliding the fitting-ensuring member 13 through the fitting-ensuring member guide projections 27 and 27, the engagement portion 36 can lock the retained condition of the retaining projection 19 (of the male connector housing 14) and the lock portion 31 (of the elastic lock arm 28) in a double manner.

As described above, in the connector 10 embodying the present invention, the fitting-ensuring member 13 is dropped through the abutment portion 38 to hold the elastic lock arm 28 against elastic deformation. Therefore, the fitting-ensuring member 13 differs from the conventional fitting detection member in that the conventional fitting detection member is slid while its distal end portion is much elastically deformed. Therefore, the double lock can be effected with the simple operation without requiring a large inserting force and also without requiring the elastic lock arm to have a large elastic force. And besides, the fitting-ensuring member 13 has no elastic detection arm (as in the conventional construction) which is advanced while being elastically deformed, and therefore the double lock can be effected in a space-saving manner. Therefore, the positive double lock can be secured, and besides the efficiency of the operation can be enhanced, and furthermore the compact design can be achieved.

In the connector 10 of the invention, when the engagement portion 36 of the fitting-ensuring member 13 is to be brought into engagement with the lock portion 31 of the elastic lock arm 28 through the abutment portion 38, the fitting-ensuring member 13 slides past the retaining projection 19 of the male connector housing 14 and the lock portion 31 of the elastic lock arm 28. Therefore, the fitting-ensuring member 13 can lock the retaining projection 19 and the lock portion 31 together in a double manner with the simple structure, and a mold of a complicated shape is not required, and therefore the productivity can be enhanced. Furthermore, the fitting-ensuring member 13 does not need to have high degree of elasticity as required in the conventional construction, and therefore this fitting-ensuring member 13 can be easily molded, and can be easily produced using already-installed facilities.

The present invention is not limited to the above embodiment, and suitable modifications, improvements and so on can be made. For example, the number of the male terminals as well as the number of the female terminals is suitably determined according to the number of circuits for wire harnesses to which this connector is applied, and therefore is not limited.

What is claimed is:

1. A connector, comprising:

a male connector housing having a retaining projection;

a female connector housing having an elastic lock arm which is brought into retaining engagement with said retaining projection of said male connector housing when said male connector housing is inserted and fitted into said female connector housing; and a fitting-ensuring member which is brought into engagement with said elastic lock arm, retainingly engaged with said retaining projection, to hold said elastic lock arm against elastic deformation;

wherein said female connector housing includes a hood portion disposed outwardly of said elastic lock arm, and a guide for supporting said fitting-ensuring member in a manner to enable a movement of said fitting-ensuring member; and an abutment portion is formed at one of said hood portion and said fitting-ensuring member, and during the movement of said fitting-ensuring member through said guide, said abutment portion abuts against a distal end portion of said fitting-ensuring member to cause said fitting-ensuring member to drop into said elastic lock arm.

2. The connector according to claim 1, wherein said elastic lock arm has a lock portion for retaining engagement with said retaining projection of said male connector housing, and said fitting-ensuring member has an engagement portion for engagement with said lock portion of said elastic lock arm, and when said engagement portion of said fitting-ensuring member is to be brought into engagement with said lock portion of said elastic lock arm through said abutment portion, said fitting-ensuring member slides past said retaining projection and said lock portion.

* * * * *